US005867957A

United States Patent [19]

Holtrop

[11] Patent Number: 5,867,957

[45] Date of Patent: Feb. 9, 1999

[54] SOUND INSULATION PAD AND USE THEREOF

[75] Inventor: James S. Holtrop, Washington, Mo.

[73] Assignee: Solutia, Inc., St. Louis, Mo.

[21] Appl. No.: 735,062

[22] Filed: Oct. 17, 1996

[51] Int. Cl.[6] ..... E04B 5/00

[52] U.S. Cl. ..... 52/403.1; 52/144; 52/408; 181/290; 181/284

[58] Field of Search ..... 52/403.1, 408, 52/409, 404.1, 302.1, 263, 144, 309.9, 309.11; 248/633; 181/290, 284

[56] References Cited

U.S. PATENT DOCUMENTS

| | | | |
|---|---|---|---|
| 3,501,878 | 3/1970 | Segal | 52/144 |
| 3,619,964 | 11/1971 | Passaro et al. | 52/309 |
| 3,729,364 | 4/1973 | Doleman et al. | 161/36 |
| 3,934,421 | 1/1976 | Daimler et al. | 61/35 |
| 4,012,249 | 3/1977 | Stapp | 156/167 |
| 4,598,000 | 7/1986 | Mantarro | 428/17 |
| 4,681,786 | 7/1987 | Brown | 428/44 |
| 4,685,259 | 8/1987 | Eberhart et al. | 52/144 |
| 4,851,277 | 7/1989 | Valkenburg et al. | 428/167 |
| 4,879,856 | 11/1989 | Jones et al. | 52/403 |
| 4,910,936 | 3/1990 | Abendroth et al. | 52/403.1 |
| 5,052,157 | 10/1991 | Ducroux et al. | 52/126 |
| 5,159,896 | 11/1992 | Mortillo et al. | 119/50.5 |
| 5,187,905 | 2/1993 | Pourtau et al. | 52/144 |
| 5,383,314 | 1/1995 | Rothberg | 52/408 X |
| 5,489,462 | 2/1996 | Sieber | 52/302.6 X |
| 5,572,842 | 11/1996 | Stief et al. | 52/403.1 |
| 5,619,832 | 4/1997 | Myrvold | 52/403.1 |

FOREIGN PATENT DOCUMENTS

| | | | |
|---|---|---|---|
| 92039227A | 12/1994 | Brazil . | |
| A2331067 | 9/1989 | European Pat. Off. . | |
| 54-42823 | 4/1979 | Japan . | |
| 63-308153 | 12/1988 | Japan . | |
| 880388 | 10/1961 | United Kingdom | 52/403.1 |

OTHER PUBLICATIONS

Enkasonic Sound Control Matting, Product Brochure, Akzo Industries, N.C. (1990).

*Primary Examiner*—Carl D. Friedman
*Assistant Examiner*—Winnie S. Yip
*Attorney, Agent, or Firm*—Fitzpatrick, Cella, Harper & Scinto

[57] ABSTRACT

A sound insulation pad for inhibiting sound transmission between floors comprised of thermoplastic material having a three-dimensional shaped surface. The invention also relates to a sound rated floor system using the sound insulation pad and a method of constructing such sound rated floor system.

46 Claims, 4 Drawing Sheets

SOUND INSULATION PAD AND USE THEREOF

BACKGROUND OF THE INVENTION

2. Field of the Invention

The present invention relates to a thermoplastic sound insulation pad for inhibiting sound transmission between floors. The pad is comprised of a thermoplastic material having a three-dimensional shaped surface. The invention also relates to a sound rated floor system using the sound insulation pad. The invention further relates to a method of constructing such a sound rated floor system.

2. Related Background Art

The transmission of sound between floors in multistory dwellings and commercial buildings can be a serious problem. The sound that is transmitted between floors is usually due to either impact sound generated on the floor or airborne sound. The transmission of sound between floors may disturb or be an annoyance to the users of the area below the room in which the sound is generated.

In general, impact sound is generated due to pedestrian footfall on the floor, movement of heavy objects over the floor and any other contact made with the floor. Airborne sound is usually due to speech or music. The transmission of sound between floors is particularly a problem where the upper finished flooring is made of concrete, ceramic tiles, or hardwood. Installation of thick carpeting may be required in order to prevent the transmission of sound. However, in heavy traffic areas such as restaurants, hospitals, government buildings and other commercial buildings this may not be a practical solution. The use of carpeting may result in an increase in building operation expenses due to additional maintenance, cleaning and floor covering replacement cost. Moreover, the use of a hard floor surface such as ceramic tiles, stone and the like in a heavy traffic area is more desirable due to the greater durability of the flooring and the ease of maintenance. An alternative to the use of carpeting to prevent sound transmission has been the use of a sound rated floor system or a floating floor. The use of a sound rated floor system or a floating floor substantially reduces the transmission of sound between floors by isolating the flooring from the floor substructure.

A sound rated flooring is disclosed in U.S. Pat. No. 4,685,259 which comprises a sound attenuation layer having a composite panel structure which is placed on a subfloor. The composite panel structure has a core and at least one acoustically semi-transparent facing of fibrous material bonded to the core and a rigid layer on the sound attenuation layer. The core of the composite panel structure is a walled structure such as a honeycomb formed of cardboard, kraft paper or aluminum. The facing placed on the core is a fibrous material such as fiber glass.

A rigid layer is placed on top of the attenuation layer to support the upper finished flooring.

In a floating floor system an intervening sound isolating layer is incorporated between the walking surface and the joists of the floor. Sound isolating materials such as foamed rubbers or mineral wools are used to create a sound insulating layer between the floor and the floor support joists. However, the use of floating floor construction in upgrading an existing floor results in an increase in its thickness, which may result in a loss of clearance for door openings. In U.S. Pat. No. 4,879,856 a floating floor system for use with joisted floors is disclosed which does not substantially raise the level of the floor. Inverted channel section floor supports are mounted longitudinally on the floor joists. The inverted channel has outwardly directed flanges between the joists. Sound insulation material is interposed on the outward directed flanges between the joists. The flooring is extended over the insulation material and secured to the joists.

Another method used to prevent the transmission of sound between floors has been the use of a sound control matting designed by AKZO industries in conjunction with the Ceramic Tile Institute (CTI) and sold under the trademark name ENKASONIC. ENKASONIC is a 0.4 inch thick matting composed of nylon filaments forming a three-dimensional geomatrix with a non-woven fabric which is heat bonded to the upper surface of the nylon. ENKASONIC matting is used in the construction of a subfloor to prevent the transmission of sound between floors.

The use of elastic foam to prevent the transmission of sound through a floor is also known in the prior art.

In U.S. Pat. No. 4,681,786 a horizontal-disassociation-cushioning layer underneath a tile floor is disclosed. The horizontal-disassociation-cushioning layer is a sheet of elastic foam from about ⅛ to ½ inch thick. The presence of the horizontal-disassociation-cushioning-layer in the floor construction substantially diminishes the transmission of impact sound to the area below the floor.

The present invention provides for a sound insulation pad that is effective in reducing the transmission of sound between floors. Additionally, the disclosed sound insulating pad permits a cost-effective method for preventing sound transmission either in existing floors which are being upgraded or in the construction of new floors.

SUMMARY OF THE INVENTION

The present invention relates to a sound insulation pad for inhibiting sound transmission between floors. In particular, the sound insulation pad is comprised of a thermoplastic material having a three-dimensional shaped surface. The invention also relates to the use of a sound insulation pad in a sound rated floor system. The invention further relates to a method of construction of a sound rated floor system.

A preferred embodiment of the invention provides for a sound insulation pad comprising, a flat thermoplastic base layer having a multitude of projections spaced from each other and extending away from the base layer.

The invention also provides for a sound rated flooring comprising:

(a) a subflooring with a sound isolating material around the perimeter of the subflooring;

(b) a thermoplastic sound insulating pad preferably unattached to and resting on the subflooring, the sound insulating pad comprising a flat base layer having a multitude of projections and extending downwardly from the base toward the subflooring;

(c) a rigid layer covering the sound insulating pad; and (d) an upper finished flooring supported on the rigid layer.

The invention further provides for a method for constructing a sound-rated floor comprising the steps of:

(a) laying down a subflooring;

(b) lining the perimeter of the subflooring with a sound isolating material;

(c) placing a thermoplastic sound insulating pad on the subflooring, the sound insulating pad comprising, a flat base layer having a multitude of projections and extending downwardly from the base toward the subflooring;

(d) laying a rigid layer on the sound insulating pad; and (e) laying a finished flooring on the rigid layer.

BRIEF DESCRIPTION OF THE DRAWINGS

In describing the overall invention, reference will be made to the accompanying drawings, wherein.

DETAILED DESCRIPTION OF THE INVENTION

Figure 1:
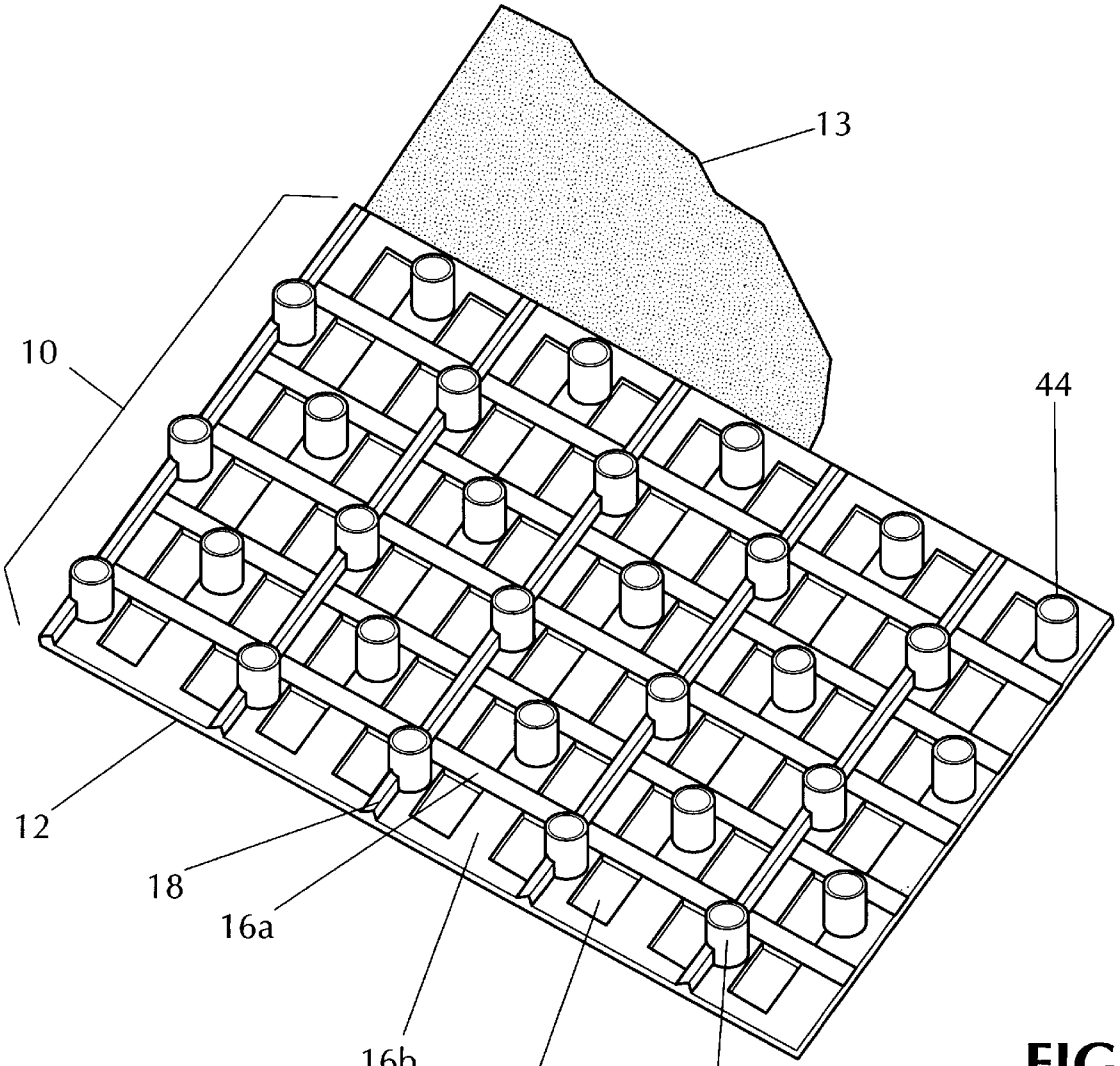
FIG. 1 is a partial, three dimensional view of one embodiment of a sound insulating pad of the invention.

Thermoplastic sound insulating pad 10 (FIG. 1) comprises, a one-piece flat base layer 12 having a multitude of hollow cylindrical projections 14 extending from the base layer. Layer 12 comprises ninety degree intersecting flat members 16*a* and 16*b* defining openings 16 between the intersections and ribs 18 projecting from the surface of every other row of member 16*a*. Ribs 18 serve to hold the pad together and in the illustrated embodiment are triangular in cross section. Though preferred, openings 16 are optional, and serve to reduce the thermoplastic material required to make the pad, thus reducing the manufacturing cost of the pad. Fabric layer is bonded to the face of the base layer opposite that from which the cylindrical projections extend. The layer of fabric extends beyond the perimeter of base layer 12 to form a fabric flap 13 whose function will be later described.

The thickness of base layer 12 may vary and is preferably about 20 to about 150 mils, more preferably about 25 to about 50 mils and most preferably about 30 mils. Below 20 mils, layer 12 tends to be structurally unsound.

Figure 2:
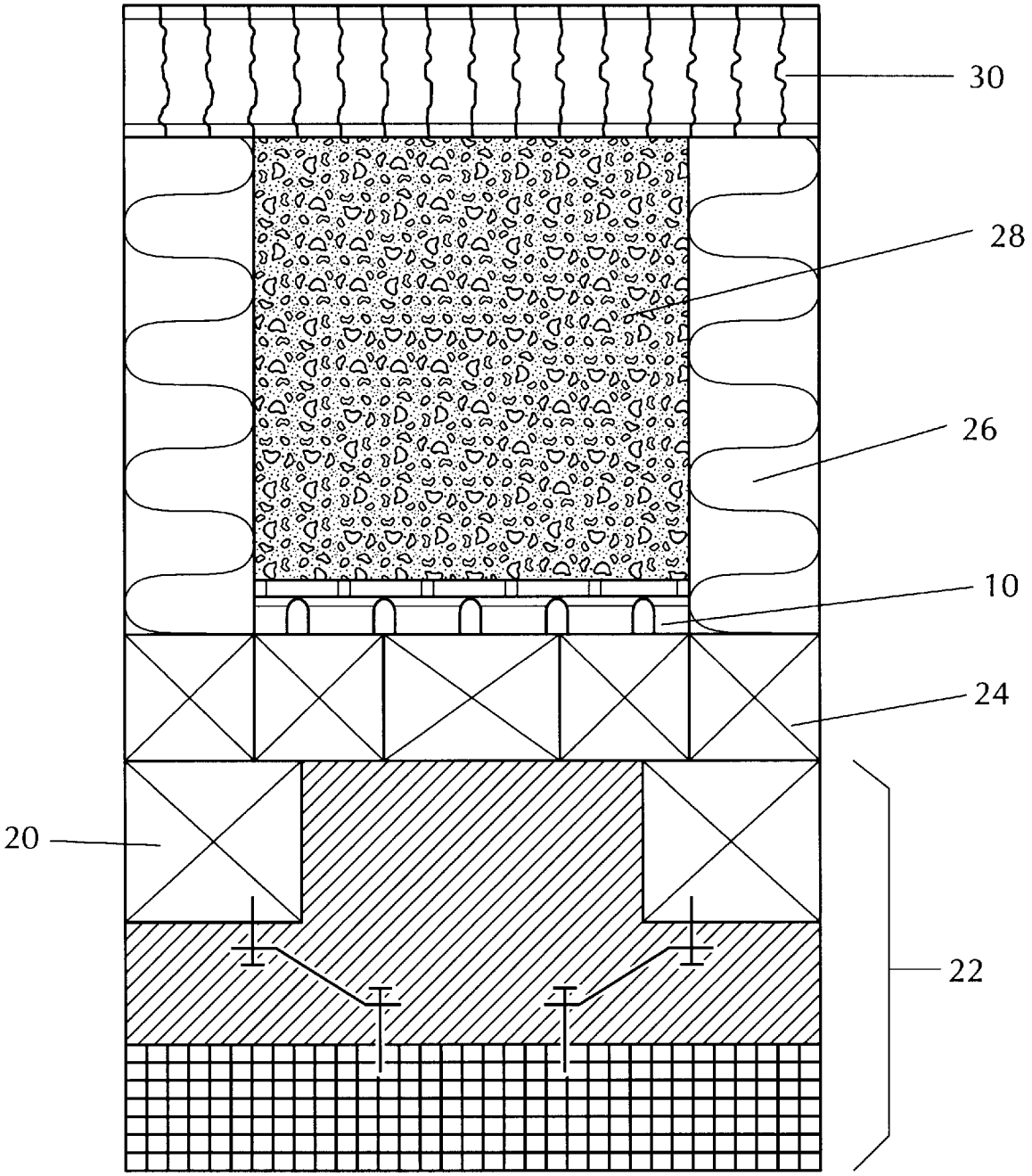
FIGS. 2 and 3 are schematic views of a flooring system of the invention employing the sound insulating pad of FIG. 1.

FIG. 2 depicts a wood joist sound rated floor system with sound insulating pad 10 incorporated therein. The sound rated floor system is comprised of wood joist 20; ceiling assembly 22; plywood subfloor 24; sound insulating pad 10; sound isolating material 26; rigid layer 28; and finished flooring 30.

Figure 3:
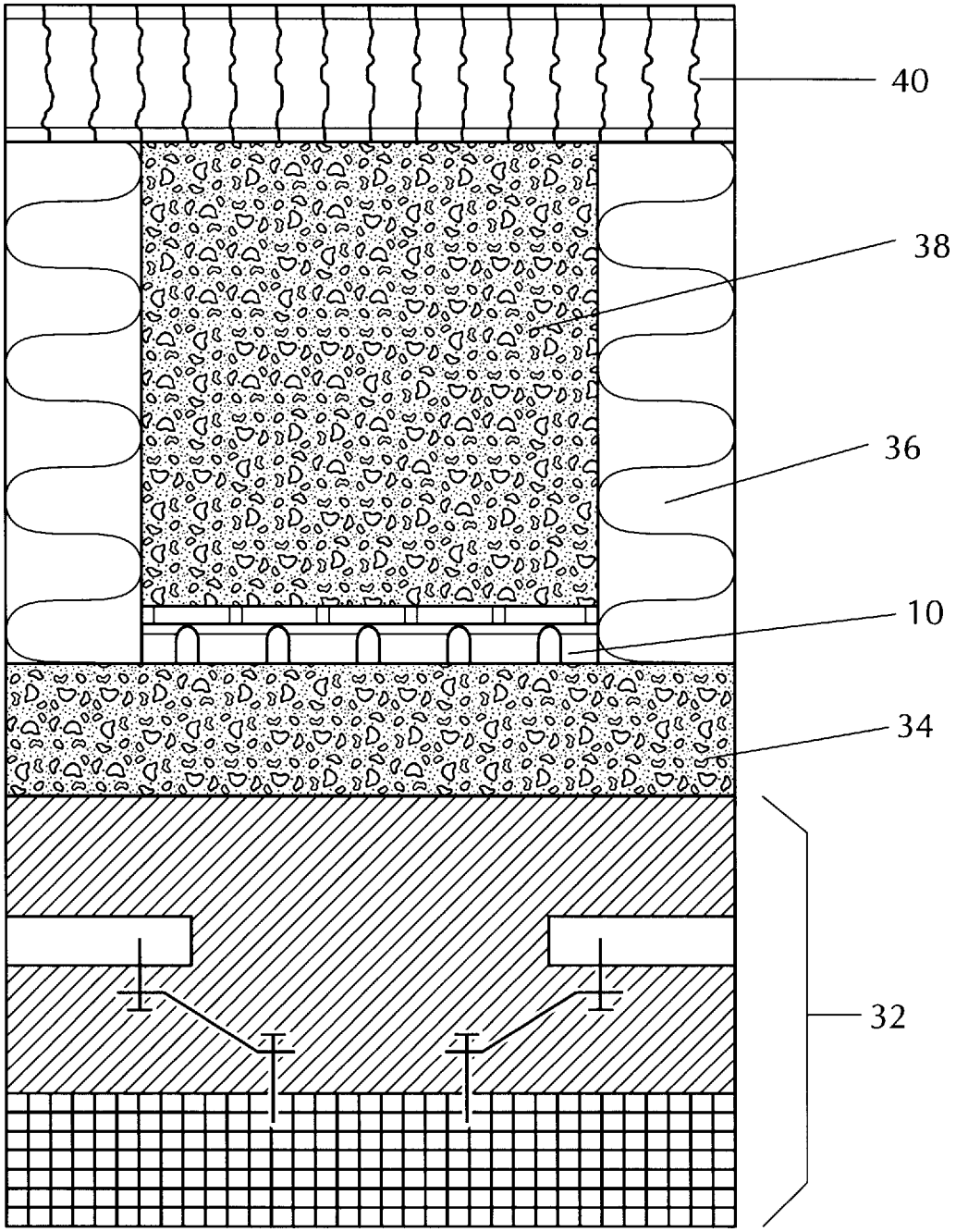

FIG. 3 shows a concrete sound rated floor system with sound insulating pad 10 incorporated therein. System comprises ceiling assembly 32; concrete subfloor 34; sound insulating pad 10; sound isolating material 36; rigid layer 38; and finished flooring 40.

Sound insulating pad 10 is preferably made by the continuous injection molding process described in U.S. Pat. No. 3,792,364 to Doleman et al., which is incorporated herein by reference. Sound insulation pads of somewhat different specific configuration than FIG. 1 may also be prepared using conventional pressure or vacuum forming techniques for shaping thermoplastic sheeting known to those of ordinary skill in the art. For example, a thermoforming process in which a press with male projections is closed from each side on a thermoplastic sheet at elevated shaping temperatures may be used wherein the male projections displace localized portions out of the plane of the sheet to form a multitude of spaced complimentary female projections on the sheet in a random or ordered pattern. Pad 10 may likewise be made with a thermoforming process wherein an extruded thermoplastic sheet at elevated temperature is brought into contact with a slightly cooled surface of a drum containing perforations communicating with a source of vacuum. Projections on the sheet are formed when the vacuum pulls the thermoplastic material through the perforations of the drum.

Projections 14 may be solid but are preferably hollow and of any cross sectional shape, such as cylindrical, triangular, square, conical pedestal, frusto-conical and the like. When sufficiently plentiful, grass-like blades are usable. Grass-like blades are relatively thin projections, triangular in cross section, and are disclosed in U.S. Pat. No. 3,729,364 to Doleman et al. Preferably, the projections are generally cylindrical in shape to provide a load bearing surface (44 in FIG. 1) at its outer extremity. Projections 14 and their arrangement on base 12 serve many functions. Their spaced arrangement provides an air gap between flooring layers to minimize sound transmission. They also provide support for weight imposed on the flooring above. Projections 14 may vary in length and are generally from about 0.05 to about 6 inches, preferably from about 0.08 to about 0.5 inches, and most preferably about 0.4 inches long. When cylindrical, the diameter of the projections and thickness of the wall forming them depends on the load bearing qualities required for a floor. In a preferred embodiment, for residential or commercial use the sound insulation pad 10 has cylindrical projections 14 extending from flat base layer 12 wherein projections are about 0.3 inches long with a diameter of about 270 mils and wall thickness of about 20 mils.

The number of projections required per square inch of base layer 12 of pad 10 also depends on the load to be borne for a particular floor as well as the nature of the materials forming the projections, their height and cross sectional dimensions. Typically, for residential or commercial floors sound insulating pads 10 with cylindrical projections intersecting at ninety degrees are made of polyethylene have 0.5 to 8 cylinders per square inch. When the flat base layer is ribless, the projections of the sound insulating pad extend from the flat base layer in a symmetrical or unsymmetrical manner.

Base layer 12 of pad 10 may be flat or ribbed. When ribbed, the ribs are spaced apart from each other and project from and are integrally molded to parallel rows of strips in the flat base. The ribs may all have the same or different thickness which is usually from about 20 to about 150 mils. In a preferred embodiment, the thicknesses of the rows of ribs are different and serve to reduce the thermoplastic material required to make the pad, thus reducing the manufacturing cost of the pad. Thus in FIG. 1, the rib rows 16, 16*a* and 18 are 30, 60 and 110 mils thick, respectively.

The sound insulation pad of the present invention may be in bulk, roll form or individual sections of any overall shape or size convenient for transportation and eventual installation. When the sound insulation pad is installed in a subflooring, it is laid end to end and/or side to side with adjoining edges of the pads butted together. These edges are then taped or glued to anchor the pads in place.

In one preferred embodiment, the sound insulation pad has a fabric layer attached to the base layer. The fabric layer may be of woven or non-woven material. A non-woven fabric may be polypropylene or polyester. The fabric layer may be pressed into the ribs of the molten plastic pad following production to form a mechanical lock. Alternatively, the fabric layer is glued to the face of the base layer opposite that from which the multitude of projections extend.

Ultrasonic spot welding may also be used to attach the frabric layer to the base layer of the sound insulating pad. In ultrasonic spot welding the flat base layer is heated with ultrasonic sound while simultaneously pressing the fabric layer into the base layer to form a mechanical lock without distorting the cylinders of the pad.

In one preferred embodiment, the fabric layer on the base layer extends outward of the edge of the base layer forming flaps to facilitate installation. The fabric flaps of adjoining sections of sound insulation pads are overlaid and taped or glued to keep the pads in place in a subflooring. Such a flap is shown at 13 in FIG. 1.

Any thermoplastic materials which can be shaped may be used in the preparation of the three dimensional sound insulating pad. Preferably, the sound insulating pad is shaped from a thermoplastic material selected from the group consisting of polyolefins such as polyethylene and polypropylene; polyvinyl halides such as polyvinyl chloride, polyvinylidene chloride, polyvinyltetrafluoride, polyvinyl chlorotrifluoride; polystyrene, particularly rubber modified polystryene; polyvinylesters such as polyvinyl acetate; and mixtures and copolymers thereof. Other preferred materials include thermoplastic condensation polymers such as polyamides, nylon polymers, acetonitrile-butadiene-styrene, segmented polyurethanes, polyurethane rubbers, silicon rubbers, natural and synthetic rubbers and polyesters. In some cases the properties of the thermoplastic product may be purposely modified to improve appearance or durability and performance through the addition of various pigments and stabilizers.

In one preferred embodiment, the sound insulating pad is formed of low density polyethylene when the upper finished flooring comprises ceramic tiles. The use of low density polyethylene minimizes cracking of rigid ceramic tiles when the floor is subjected to an impact load.

Preferably the subflooring of the sound rated floor system is selected from the group consisting of plywood, poured concrete, precast concrete and concrete slabs.

The sound isolating material component around the perimeter of the subflooring prevents the flanking of sound, i.e., transmission between floors through the walls. The sound isolating material may be polyethylene foam, polyurethane foam, fiberglass board, or the sound insulation pad of the present invention. The polyethylene and polyurethane foam in such use are about ⅜ inches thick.

The rigid layer of the sound rated floor system is selected from wood, plywood, mortar bed, reinforced concrete, glass mesh mortar and concrete with fiber glass scrim. Glass mesh mortar material is available from Modulars Inc., Hamilton, Ohio, under the trademark WONDER BOARD®. Concrete with fiber glass scrim is available from Gyp-Crete Corp., Hamel, Minn., under the trademark GYP-CRETE®.

Many types of finished flooring may be used in the sound rated floor system and may be selected from the group consisting of ceramic tile, marble, stone, vinyl composition tile, wood block parquet, carpet, melamine laminate and tongue and groove hardwood. Melamine laminate is available from Wilsonart International Flooring, Temple, Tex. under the trademark WILSONART FLOORING®.

Sound rated floors are classified according to their impact insulation class (IIC) and sound transmission class (STC) values. IIC is measured from impact sound or noise, such as footfall, that will be transmitted through a floor to an area below. The greater the IIC value the less impact sound will be transmitted to the area below the floor. STC is measured from airborne sound, such as speech or music, that will be transmitted through a floor to an area below. The greater the STC value the less airborne sound will be transmitted through the floor to the area below.

Building codes generally require that both IIC and STC values for sound rated floors are not less than 50. The IIC and STC values for the sound rated floor systems of the present invention were determined, with ceilings attached, and found to exceed 50. Even without a ceiling, a floor system using the sound insulation pad of the present invention had IIC and STC values greater than 50.

In addition to inhibiting sound transmission, the disclosed sound insulating pads may assist in avoiding staining of the finished floor. For example, with vinyl or carpeted floorings staining may occur due to "bottoms-up-staining," when plasticizer in the vinyl flooring or adhesive on carpet backings reacts over time with glue or resin coatings on nail heads in the subflooring in contact with the vinyl or carpet. The resulting reaction product can migrate from the interface of the vinyl or carpet with the subfloor to the exposed upper floor surface, which results in a stain on the exposed floor surface. The sound insulating pad of the invention creates an air space between the vinyl or carpet floor and the subfloor to prevent such migration and thereby avoid staining the flooring. Additionally, glue (for example in plywood) and coating components typically used in the subfloors usually do not react with polyethylene when the sound insulating pad is made of this preferred material.

Another feature of the disclosed sound insulating pad facilitates temperature control of the finished flooring for convenience by circulating air through the sound insulating pad. This is especially useful where the finished flooring comprises a relatively hard surface such as ceramic tiles or vinyl. During summer it may be desirable to have the exposed walked-on surface of the finished floor be cooled by circulating cool air in the air space in the sound insulating pad. Conversely, during winter the air circulating system could increase the temperature of the walked-on surface by blowing warm air through the sound insulating pad.

A further and rather important feature of the sound insulating pad is to facilitate replacement of the floor of a sound rated flooring system. In the past building owners were reluctant to replace ceramic floor tiles with different designs or color because of the difficulty of removing the tiles. For an average size ceramic tiled floor this could take up to two days of labor to remove the floor. With the system of this invention, a small portion (e.g., one tile) of the floor is manually broken and removed to expose the sound insulating pad below. The sound insulating pad is then manually pulled up to dislodge everything above it including the ceramic tiles. This is continued until all the finished floor is removed.

This invention will be better understood from the Example which follows. However, one skilled in the art will readily appreciate that the specific methods and results discussed are merely illustrative of the invention and no limitation of the invention is implied.

EXAMPLE 1

Inhibition of Sound Transmission Using Sound Insulating Pads (A) Description of Sound Insulation Pads (1)–(7)

A typical sound insulation pad of the present invention is shown in FIG. 1. In the following example, the sound insulation pads SD-3 through SD-6 comprise hollow cylindrical projections which extend from a ribbed base layer. The projections are about 0.3 inches long with a diameter of about 270 mils and wall thickness of about 20 mils. The thicknesses of the rows of ribs for SD-2 though SD-6 are as shown FIG. 1, rib rows 16, 16*a* and 18 are 30, 60 and 110 mils thick, respectively.

(1) SD-1 is a standard ASTROTURF® doormat grass pad which comprises 0.70 inches long grass with 70 mils blade thickness which has been textured and 4.5 ounces/square yard of non-woven polypropylene fabric is attached to the back of the ASTROTURF® base layer. ASTROTURF® doormat grass pad is available from the Monsanto Company, St. Louis, Mo.;

(2) SD-2 is a standard ASTROTURF® doormat grass pad which comprises ⅜ inches long grass which has not been textured and 4.5 ounces/square yard of polypropylene fabric is attached to the back of the ASTROTURF® base layer;

(3) SD-3 is a sound insulating pad of the present invention (see FIG. 1) made from high density polyethylene with 5.5 ounces/square yard of non-woven polypropylene fabric attached to the back of the base layer;

(4) SD-4 is a sound insulating pad of the present invention (see FIG. 1) made from low density polyethylene with 5.5 ounces/square yard of non-woven polypropylene fabric attached to the back of the base layer;

(5) SD-5 is a sound insulating pad of the present invention (see FIG. 1) made from low density polyethylene with 4.5 ounces/square yard of non-woven polypropylene fabric attached to the back of the base layer;

(6) SD-6 is a sound insulating pad of the present invention (see FIG. 1) made from high density polyethylene with no fabric attached to the back of the base layer; and (7) A control—no sound insulation pad.

(B) Preparation of Floor Construction Using the Sound Insulation Pads (1)–(6) and the Control (7).

A laboratory test floor piece of approximately nine square feet was constructed. From the top down the floor consisted of 8.5 inch by 8.5 inch by 0.5 inch thick unglazed cement body tile by RO●TILE grouted (Rotile Inc., Lodi, Calif.) with Summitville Polychrome S-710 sanded joint filer (Summitville Tiles Inc., Summitville, Ohio). The tile was set to 0.5 inch thick WONDER BOARD® Cementitious Backer Units (CBU) with latex modified thin set mortar (Modulars Inc., Hamilton, Ohio). The test floor piece was then placed upon each of the sound insulation pads (1)–(7).

Each of the floor constructions with the different sound insulation pads (1)–(6) were place in turn in the center of a concrete sub floor to determine their ability to inhibit transmission of sound between floors. A control reading was also taken for the transmission of sound in the absence of a sound insulating pad.

The concrete subfloor consisted of ten nominally 24 inch wide by 167 inch by 8 inch thick Flexicore Model #824A-D-22 precast concrete slabs. The gaps between the slabs were filled with sand and sealed with caulk. No ceiling was attached to the bottom of the concrete slabs.

Figure 4:
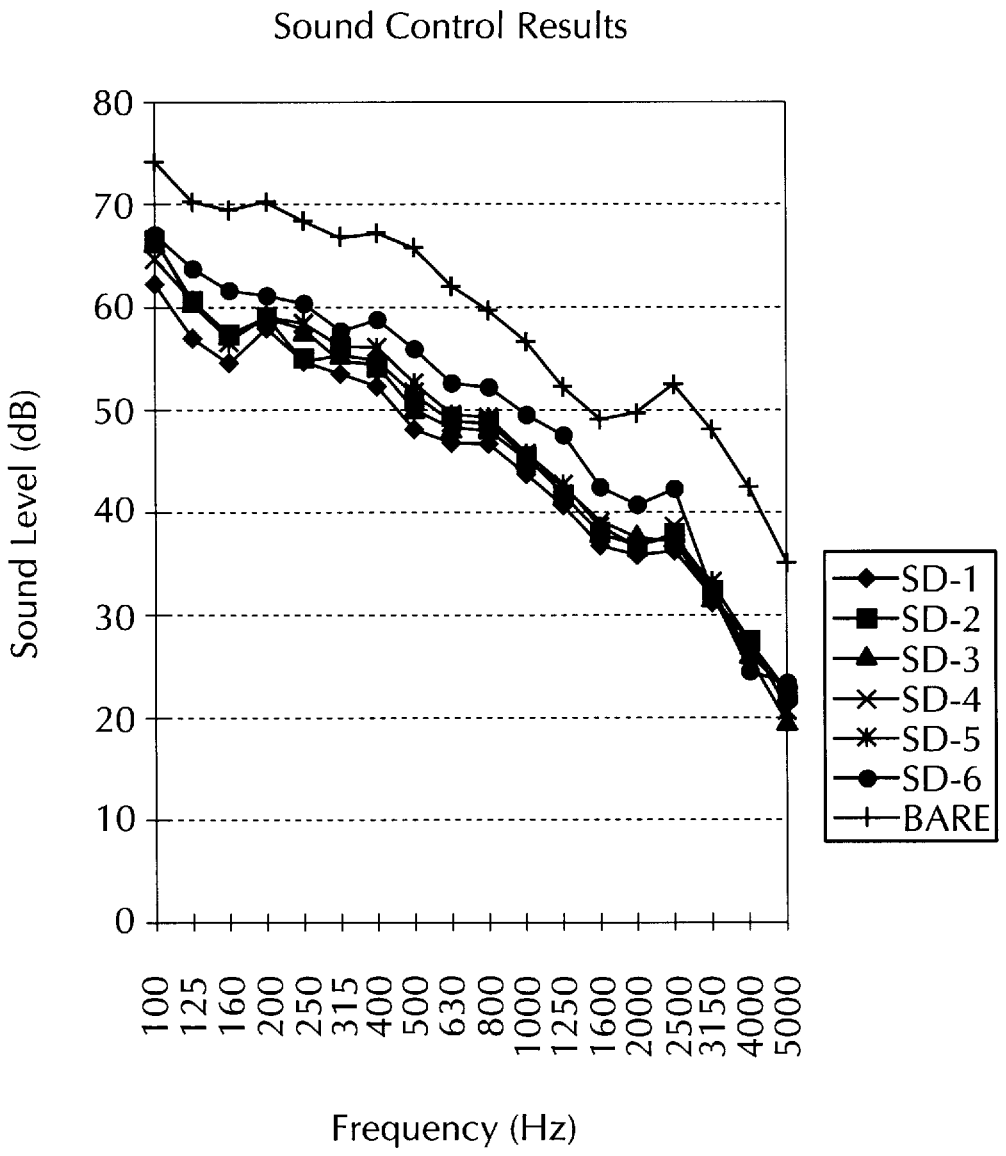
FIG. 4 is a plot of Sound Level (dB) versus Frequency (Hz) representing the results of Example 1.

Each of the floor constructions using the sound insulating pads were tested using a Bruel and Kjar tapping machine placed on the center of a tile. One third octave measurements in the receiving room were measured in accordance with the American Standard Test Method "ASTM" Test E492-90 and the results are shown in Table 1 and graphically in FIG. 4.

| Hz | SD-1 (1) | SD-2 (2) | SD-3 (3) | SD-4 (4) | SD-5 (5) | SD-6 (6) | Bare (7) |
|---|---|---|---|---|---|---|---|
| 100 | 62.8 | 66.9 | 67.1 | 67.4 | 65.2 | 67.5 | 74.7 |
| 125 | 57.5 | 61 | 61.2 | 60.9 | 61.5 | 64.2 | 70.8 |
| 160 | 55 | 58 | 57.5 | 57.7 | 57 | 62 | 70.1 |
| 200 | 58.5 | 58.9 | 59.8 | 59.8 | 60.1 | 61.5 | 70.8 |
| 250 | 55.1 | 55.4 | 58.1 | 58.5 | 58.9 | 60.7 | 69 |
| 315 | 54 | 55.9 | 43.7 | 54.9 | 56.4 | 58 | 67.3 |
| 400 | 52.7 | 54.5 | 55.4 | 55.7 | 56.5 | 59.1 | 67.6 |
| 500 | 48.5 | 50.5 | 51.9 | 52.6 | 53 | 56.1 | 66.3 |
| 630 | 47.1 | 48.2 | 49 | 49.5 | 50 | 53 | 62.5 |
| 800 | 47.1 | 49.3 | 48.1 | 49.4 | 48.5 | 52.5 | 60 |
| 1000 | 44.1 | 45.7 | 46 | 45.5 | 46.1 | 49.8 | 57 |
| 1250 | 41 | 42 | 42.5 | 42.5 | 43.1 | 47.8 | 52.6 |
| 1600 | 37 | 38.5 | 39 | 39.4 | 38.5 | 42.8 | 49.4 |
| 2000 | 36 | 36.7 | 38 | 37.5 | 37.2 | 41.1 | 49.9 |
| 2500 | 36.5 | 37.9 | 38.4 | 38.5 | 38.2 | 42.5 | 52.9 |
| 3150 | 31.5 | 31.9 | 32.9 | 32.5 | 33.5 | 33 | 48.4 |
| 4000 | 27.1 | 27.7 | 25.5 | 26.4 | 27.4 | 24.5 | 42.8 |
| 5000 | 21.9 | 22.4 | 20 | 20.5 | 21 | 23.4 | 35.3 |

Table 1. Sound levels (dB) for floor constructions incorporating the sound insulating pads (1)–(6) at different frequencies (Hz). The sound levels (dB) for the control (7), a floor construction without a sound insulating pad are also shown at different frequencies.

The use of the sound insulating pads (1)–(6) compared to the control (7) which did not have a sound insulation pad present in the flooring construction resulted in a significant reduction in the transmission of sound from the source room to the receiving room as indicated by the results in Table 1.

What I claim is:

1. A thermoplastic sound insulation pad comprising a flat base layer having intersecting members defining openings between intersections and a multitude of projections on the intersecting members extending away from the base layer.

2. The thermoplastic sound insulation pad of claim 1, wherein the flat base layer is about 20 mils to about 150 mils thick.

3. The thermoplastic sound insulation pad of claim 1, further comprising a fabric layer attached to the flat base layer.

4. The thermoplastic sound insulation pad of claim 3, wherein the fabric layer is either woven or non-woven.

5. The thermoplastic sound insulation pad of claim 4, wherein the non-woven fabric layer is polypropylene or polyester.

6. The thermoplastic sound insulation pad of claim 1, wherein the multitude of projections are cylindrical in shape.

7. The thermoplastic sound insulation pad of claim 1, wherein the multitude projections are about 0.05 inches to about 6 inches long.

8. A sound rated flooring comprising:

(a) a subflooring with a sound isolating material around the perimeter of the subflooring;

(b) a thermoplastic sound insulating pad preferably unattached to and resting on the subflooring, the sound insulating pad comprising, a flat base layer having a multitude of projections and spaces between said multitude of projections being open, said multitude of projections extending downwardly from the base layer toward the subflooring;

(c) a rigid layer covering the sound insulating pad; and (d) an upper finished flooring supported on the rigid layer.

9. The sound rated flooring of claim 8, wherein the multitude of projections are spaced from each other.

10. The sound rated flooring of claim 8, wherein the flat base layer is about 20 mils to about 150 mils thick.

11. The sound rated flooring of claim 8, wherein the sound insulation pad further comprises a fabric layer attached to the flat base layer.

12. The sound rated flooring of claim 11, wherein the fabric layer is either woven or non-woven.

13. The sound rated flooring of claim 12, wherein the non-woven fabric layer is polypropylene or polyester.

14. The sound rated flooring of claim 8, wherein the sound insulating pad is shaped from a material selected from the group consisting of polyamides, segmented polyurethanes, polyurethane rubbers, silicon rubbers, polyethylene, polypropylene, polyvinyl chloride, polyvinylidene chloride, polyvinyltetrafluoride, polyvinyl chlorotrifluoride, polystyrene, polyvinyl acetate, and mixtures and copolymers thereof.

15. The sound rated flooring of claim 14, wherein the polyethylene is low density polyethylene or high density polyethylene.

16. The sound rated flooring of claim 8, wherein the sound insulation pad's multitude of projections have a shape selected from the group consisting of cylindrical, triangular, square, conical pedestal and frusto-conical.

17. The sound rated flooring of claim 16, wherein the multitude of projections are cylindrical in shape.

18. The sound rated flooring of claim 8, wherein the base layer of the sound insulating pad is ribbed or ribless.

19. The sound rated flooring of claim 8, wherein the ribbed base layer has parallel rows of rib-like elements.

20. The sound rated flooring of claim 8, wherein the projections are about 0.05 inches to about 6 inches long.

21. The sound rated flooring of claim 8, wherein the subflooring is selected from the group consisting of plywood, poured concrete, precast concrete and concrete slabs.

22. The sound rated flooring of claim 8, wherein the sound isolating material is polyethylene foam, polyurethane foam or fiberglass board.

23. The sound rated flooring of claim 22, wherein the polyethylene foam or the polyurethane foam is about ⅜ inch thick.

24. The sound rated flooring of claim 22, wherein the fiberglass board is about ⅜ inch thick.

25. The sound rated flooring of claim 8, wherein the rigid layer is selected from the group consisting of wood, plywood, mortar bed, reinforced concrete, glass mesh mortar and concrete with fiber glass scrim.

26. The sound rated flooring of claim 8, wherein the upper finished flooring is selected from the group consisting of ceramic tile, marble, stone, vinyl composition tile, wood block parquet, carpet, melamine laminate and tongue and groove hardwood.

27. A method for constructing a sound-rated floor comprising the steps of:

(a) laying down a subflooring;

(b) lining the perimeter of the subflooring with a sound isolating material;

(c) placing a thermoplastic sound insulating pad on the subflooring, the sound insulating pad comprising, a flat base layer having a multitude of projections and spaces between said multitude of projections being open, said multitude of projections extending downwardly from the base layer toward the subflooring;

(d) laying a rigid layer on the sound insulating pad; and (e) laying a finished flooring on the rigid layer.

28. The method of claim 27, wherein the multitude of projections are spaced from each other.

29. The method of claim 27, wherein the flat base layer is about 20 mils to 150 mils thick.

30. The method of claim 27, wherein the thermoplastic sound insulation pad further comprises a fabric layer attached to the base layer.

31. The method of claim 30, wherein the fabric layer is either woven or non-woven.

32. The method of claim 31, wherein the non-woven fabric layer is polypropylene or polyester.

33. The method of claim 27, wherein the thermoplastic sound insulating pad is shaped from a material selected from the group consisting of polyamides, segmented polyurethanes, polyurethane rubbers, silicon rubbers, polyethylene, polypropylene, polyvinyl chloride, polyvinylidene chloride, polyvinyltetrafluoride, polyvinyl chlorotrifluoride, polystyrene, polyvinyl acetate, and mixtures and copolymers thereof.

34. The method of claim 33, wherein the polyethylene is low density polyethylene or high density polyethylene.

35. The method of claim 27, wherein the thermoplastic sound insulation pad's multitude of projections have a shape selected from the group consisting of cylindrical, triangular, square, conical pedestal and frusto-conical.

36. The method of claim 35, wherein the multitude of projections are cylindrical in shape.

37. The method of claim 27, wherein the base layer of the sound insulating pad is ribbed or ribless.

38. The method of claim 27, wherein the ribbed base layer has parallel rows of rib-like elements.

39. The method of claim 27, wherein the projections are about 0.05 inches to about 6 inches long.

40. The method of claim 27, wherein the subflooring is selected from the group consisting of plywood, poured concrete, precast concrete and concrete slabs.

41. The method of claim 27, wherein the rigid layer is selected from the group consisting of wood, plywood, mortar bed, reinforced concrete, glass mesh mortar and concrete with fiber glass scrim.

42. The method of claim 27, wherein the sound isolating material is polyethylene foam, polyurethane foam or fiberglass board.

43. The method of claim 27, wherein the polyethylene foam or the polyurethane foam is about ⅜ inches thick.

44. The method of claim 42, wherein the fiberglass board is about ⅜ inches thick.

45. The method of claim 27, wherein the finished flooring is selected from the group consisting of ceramic tile, marble, stone, vinyl composition tile, wood block parquet, carpet, melamine laminate and tongue and groove hardwood.

46. The method of claim 27, wherein the rigid layer is selected from the group consisting of wood, plywood, mortar bed, reinforced concrete, glass mesh mortar and concrete with fiber glass scrim.

* * * * *

UNITED STATES PATENT AND TRADEMARK OFFICE

CERTIFICATE OF CORRECTION

PATENT NO. : 5,867,957

DATED : February 9, 1999

INVENTOR(S) : JAMES S. HOLTROP

It is certified that error appears in the above-identified patent and that said Letters Patent is hereby corrected as shown below:

COLUMN 7

Line 41, "place" should read --placed--.

COLUMN 8

Line 44, "multitude" should read --multitude of--.

COLUMN 9

Line 22, "claim 8," should read --claim 18,--.

UNITED STATES PATENT AND TRADEMARK OFFICE

CERTIFICATE OF CORRECTION

PATENT NO. : 5,867,957

DATED : February 9, 1999

INVENTOR(S) : JAMES S. HOLTROP

It is certified that error appears in the above-identified patent and that said Letters Patent is hereby corrected as shown below:

COLUMN 10

Line 32, "claim 27," should read --claim 37,--;
Line 46, "claim 27," should read --claim 42,--.

Signed and Sealed this

Seventeenth Day of August, 1999

*Attest:*

Q. TODD DICKINSON

*Attesting Officer*

*Acting Commissioner of Patents and Trademarks*